US011484772B2

(12) United States Patent
Naumov et al.

(10) Patent No.: US 11,484,772 B2
(45) Date of Patent: Nov. 1, 2022

(54) SELF-PROPELLED VEHICLE

(71) Applicants: Boris Vladimilenovich Naumov, Moscow (RU); Vladimir Igorievich Eramov, Moscow (RU); Alexander Nemirovsky, Woodside, CA (US); George Rekouts, Emerald Hills, CA (US)

(72) Inventors: Boris Vladimilenovich Naumov, Moscow (RU); Vladimir Igorievich Eramov, Moscow (RU); Alexander Nemirovsky, Woodside, CA (US); George Rekouts, Emerald Hills, CA (US)

( * ) Notice: Subject to any disclaimer, the term of this patent is extended or adjusted under 35 U.S.C. 154(b) by 24 days.

(21) Appl. No.: 17/174,416

(22) Filed: Feb. 12, 2021

(65) Prior Publication Data

US 2021/0299547 A1 Sep. 30, 2021

(30) Foreign Application Priority Data

Mar. 26, 2020 (RU) ..... RU2020113134

(51) Int. Cl.
*A63C 5/08* (2006.01)
*A63C 5/12* (2006.01)

(52) U.S. Cl.
CPC ..... *A63C 5/085* (2013.01); *A63C 5/12* (2013.01)

(58) Field of Classification Search
CPC ..... A63C 5/08; A63C 5/085; A63C 5/12
See application file for complete search history.

(56) References Cited

U.S. PATENT DOCUMENTS 2,625,229 A 1/1953 Van Voorhees
4,519,470 A * 5/1985 Allisio ..... B62D 55/07 180/9.4
8,991,541 B1 * 3/2015 Maier ..... A63C 5/08 180/181
10,427,024 B1 * 10/2019 Barrett ..... A63C 5/035
(Continued)

FOREIGN PATENT DOCUMENTS

DE 102015014871 A1 5/2017
FR 2688701 A1 9/1993
(Continued)

*Primary Examiner* — Brian L Swenson
(74) *Attorney, Agent, or Firm* — Calderon Safran & Cole P.C.

(57) ABSTRACT

A personal self-propelled vehicle for travelling on snow using ski comprises a closed-loop flexible ribbon configured to envelope the ski over its length so as to pass under at least a portion of a sliding surface, two rollers and configured for installation on longitudinally opposite ends of the ski and to interact with the ribbon. The roller is a driving roller and is engaged with a motor comprising a control means and with the ribbon to transfer force for translational movement thereof. The roller is a guiding roller. The ribbon canvas has multiple via openings divided by webs and substantially constitutes a lattice. Dimensions and positions of the openings and parameters of the webs between them are selected so the sliding surface of the ski abuts on snow through the openings during motion of the vehicle, while the webs sink in snow under load of the vehicle bearing the user and provide repulsion from snow packed by the ski, thus assuring the ski sliding in longitudinal direction.

14 Claims, 4 Drawing Sheets

(56) References Cited

U.S. PATENT DOCUMENTS

| | | | | |
|---|---|---|---|---|
| 2004/0154849 | A1* | 8/2004 | Fodor | A63C 5/035<br>180/181 |
| 2009/0152037 | A1* | 6/2009 | Brazier | B62D 55/07<br>180/191 |
| 2017/0113119 | A1 | 4/2017 | Burger | |

FOREIGN PATENT DOCUMENTS

| | | | |
|---|---|---|---|
| RU | 2350372 | C1 | 3/2009 |
| RU | 101684 | U1 | 1/2011 |
| SU | 1681873 | A2 | 10/1991 |
| WO | 2015104663 | A1 | 7/2015 |

* cited by examiner

SELF-PROPELLED VEHICLE

BACKGROUND OF INVENTION

Field of Invention

The invention relates to vehicles. In particular, it relates to a personal self-propelled vehicle for travelling on snow using ski.

Prior Art

Ski resorts are equipped with ski lifts allowing transportation of skiers to the hillside top point for comfort downhill skiing. However, construction of such lifts is expedient for rather long pistes. Additionally, the lifts often gather long queues, which may substantially increase time period between downhill runs.

When the hillside is small, skiers and snowboarders prefer travelling uphill on their own, which is the most physically hard operation of the entire skiing process. Moving uphill is complicated as skiers have to overcome backward ski slipping when they move forward and upward. Snowboarders have to unfasten their snowboards each time and walk uphill carrying the snowboards with them. Cross-country skiers may also be tired during long skiing on a flat snow surface using cross-country ski due to need for performing repeated push movements for a long time.

Various devices are used for facilitating going uphill as well as for continuous skiing over even or rough terrain.

In particular, there is a known ski configuration of patent RU2350372 (published on 2009 Mar. 27), where the ski has a pad on its sliding surface. The pad comprises guiding elements in form of one or more projections and grooves, where shag is secured at an angle of 30° to 45° to the pad surface towards the rear portion of the ski. This configuration allows reducing backward ski slipping when moving uphill and travelling over a rough terrain. However, it facilitates motion insufficiently and hardly reduces exhaustion of a skier, as the skier still has to make efforts for travelling.

According to patent RU101684 (published on 2011 Jan. 27), there is a known personal vehicle for transporting a skier on snow, where pushing force is applied via a support handle to a lower portion of the skier's body. A track drive is used in the vehicle, where a chain has metal grousers for better traction with snow bed and a wide snowshoe is mounted at the vehicle frame bottom. The snowshoe is intended to distribute pressure and prevent sinking in snow. This vehicle is suitable for transporting a skier over a plain terrain, while in downhill skiing the vehicle is needed just when going uphill, so the skier has to bear it when going downhill, which is uncomfortable and non-expedient in view of substantial weight and size of the device. In addition, the skier's weight is distributed over the snowshoe that is located separately from the vehicle and has a large surface, so the track of the vehicle is not pressed enough to snow surface resulting in slipping effect and loss in drafting force of the drive.

Patent FR2688701 (published on 1993 Sep. 24) describes configuration of a known personal vehicle for moving on snow using at least one ski, in particular, a snowboard, having a lower surface intended for sliding on snow and an upper surface used as a support for its user. This known device comprises a track drive engaged with a driving assembly for transferring motion. It consists of two driving wheels mounted on opposite ends of the ski. The track drive starts moving upon activation of a control handle of the drive motor and propulsive force is transferred via a flexible belt transmission to the driving wheel of the track drive.

This configuration allows completely avoiding physical efforts by the user while moving uphill. However, like in the previous case, the track drive is a quite heavy device and its track elements tend to dig into snow, especially when snow is loose, resulting in skidding and stopping upward motion. In addition, presence of a heavy track drive and a driving system both extending downward from the sliding surface of the snowboard excludes possibility of natural speedy downhill sliding along a hill slope and leads to destroying the piste or any other rolled surface during its motion. If the track drive and the driving system are meant to be removable for downhill run, the skier has to move a considerable weight of the whole track device with them, which is inconvenient. Thus, this solution also cannot solve the problem of maximum possible facilitation of going uphill.

The closest prior art to the proposed personal self-propelled vehicle is the device disclosed in patent publication EP3148658A1 (published on 2017 May 4). This device comprises a closed-loop flexible ribbon-like belt that envelops a ski over its length and rests on rollers mounted on the ski ends. One of the rollers is a driving roller; it is engaged with a motor and is used for transferring motion to the belt. The other roller is a guiding roller; it assures tension of the belt. The lower portion of the belt passes below the sliding surface of the ski, and the upper portion of the belt passes through a gap under the skier's boot binding. Outer surface of the belt interacts with snow and has a means impeding backward slipping, and inner surface of the belt has transversal partitions or recesses for engaging with teeth provided on surface of the rollers. Additionally, the lower surface of the ski contains a special groove for preventing lateral shift of the belt relative to the ski sliding surface. The grove interacts with projections of the belt to hold the belt in a predetermined position. When the vehicle moves, force is transferred from the driving roller to the belt, thus providing translational movement of the belt on snow surface while the ski sliding surface moves relative to the inner surface of the belt.

This device has a far lower weight than the other devices described in the above, which use track drives. However, this device has a quite low efficiency factor due to high friction loss occurring between the ski and the inner surface of the belt while sliding, so it incurs more energy consumption resulting in decrease in time of use of the device or increase of its weight. In addition, the upper portion of the belt needs to pass under the ski binding, so the binding has to be removable and to have a particular configuration, which limits use of the device by specially equipped ski. Necessity of the holding groove in the lower surface of the ski prevents using this known device in combination with standard commercially available ski.

SUMMARY OF INVENTION

The invention is mainly aimed at providing a personal self-propelled vehicle for travelling on snow, which would be removable and would be easily installed on any industrially produced ski or snowboard as well as on other vehicle containing a ski like a sleigh or a steering sled.

Additionally, the invention is aimed at providing a personal self-propelled vehicle for travelling on snow, which would have a sufficiently high efficiency factor and a low weight so the user would carry it in a haversack, e.g., during downhill run.

Moreover, the invention is aimed at providing a highly reliable and safe-in-use device.

These and other goals are achieved by a personal self-propelled vehicle for travelling on snow using at least one ski comprising a lower surface configured for sliding on snow, and an upper surface bearing a support for a user. The vehicle comprises a closed-loop flexible ribbon configured to envelope the ski over its length and to pass under at least a portion of the sliding surface, two rollers configured to be installed on opposite ends of the ski and to interact with the ribbon. One roller is a driving roller engaged with a motor having a control means and with the ribbon for transferring force to provide translational movement of the ribbon. The other roller is a guiding roller. According to the invention, a canvas of the ribbon comprises a plurality of via openings separated by webs to substantially form a lattice, while sizes and positions of the openings and parameters of the webs located between the openings are selected so the sliding surface of the ski abuts on snow through the openings during motion of the vehicle. The webs sink in snow under load of the vehicle and the user and provide repulsion from snow packed by the ski, thus assuring ski sliding in longitudinal direction.

It is expedient to provide projections/recesses on a cylinder surface of the driving roller along circumference thereof, which projections/recesses are configured to interact with at least some of the openings.

In a preferable embodiment of the invention, the canvas of the ribbon constitutes a lattice. The canvas is made of a rope and cross-section size of the rope in vertical plane is selected to be enough for assuring repulsion of the lattice from snow packed by the ski bearing the user.

The rope may be selected from a fiber, a string, a cord, a wire and a braided line.

The lattice may be made using a method selected from braiding, welding, molding, knitting, 3D-printing and growing.

In a preferable embodiment, the lattice is made of a polymer material or has a polymer coating.

The canvas of the ribbon (the lattice) may be provided in form of at least one chain, which links are pivotally connected to each other so as to form the openings.

Depending on width of the ski, the canvas of the ribbon may be formed of at least two flexible ties having rigid transversal projections extending in a horizontal plane, between which the openings are substantially defined.

Preferably, each of the driving roller and the guiding roller is equipped with a means for detachable fastening to the front end or the rear end of the ski, correspondingly.

The fastening means may be provided in form of a removable add-on comprising an eye bar defining a through slot for push-fit engaging with the corresponding end of the ski and further comprising a couple of arms, which ends are attached to opposite sides of the eye bar, and a rotational axis of the corresponding roller, which is attached to other, unused ends of the arms.

In some embodiments, the vehicle may further comprise limiters to limit displacement of the ribbon relative to the sliding surface of the ski, in order to increase reliability of the vehicle operation. Each limiter may be provided in form of a sleeve mounted on an axis so as to provide free rotation. The sleeve may comprise a means for fastening to the ski substantially perpendicular to the longitudinal axis of the ski in a horizontal plane. Side surface of the sleeve may have radially directed needle pins. Length of each pin is more than a distance between the upper surface of the ski and the lower surface of the ribbon installed on the ski.

When the proposed vehicle is intended for downhill ski having a support for the user in form of a downhill ski binding that is one of most important components of ski equipment providing safety of the skier, the lattice may be configured so its upper portion passes along at least one of sides of the user's boot during motion of the vehicle.

In another embodiment of the vehicle intended for use with downhill ski, the lattice may be divided into two parts along its whole length so its upper portion is configured to split into two sub-portions near the ski binding, and each sub-portion passes along the corresponding side of the user's boot and then the sub-portions are combined into a single canvas on the projections/recesses of the driving roller or the guiding roller.

In the two latter cases, the vehicle is installed on ski with no any intrusion into a certified configuration of the ski binding, which is particularly important from the user safety point of view.

In yet another embodiment, where the vehicle is intended for use with cross-country ski, it may be equipped with at least one removable overlay comprising a support surface similar to a support surface of the binding and may have a passage for free passing the upper portion of the ribbon between the overlay and the ski surface.

Owing to the driving ribbon formed as a lattice having multiple cells with webs characterized by predetermined parameters, the lattice sinks into upper layer of snow packed by the ski during use of the personal self-propelled vehicle according to the invention. The ski substantially slides on snow and the webs located between the cells of the lattice sink in snow and assure enough force of repulsion from snow packed by the ski to provide longitudinal motion of the ski. This solution allows increasing efficiency factor of the device owing to sufficient decrease in friction loss and, correspondingly, decreasing energy consumption for its operation.

The proposed configuration is compact and reliable in use; it has a light weight and a small size; it is removable; it does not take much time to install and allows travelling on snow, including a hill slope, with no use of physical power of its user.

BRIEF DESCRIPTION OF DRAWINGS

The invention is further explained by description of preferable but not limiting embodiments and attached drawings, in which.

DETAILED DESCRIPTION OF EMBODIMENTS

The invention is further explained by way of description of preferable but not limiting embodiments with reference to the attached drawings.

Figure 1:
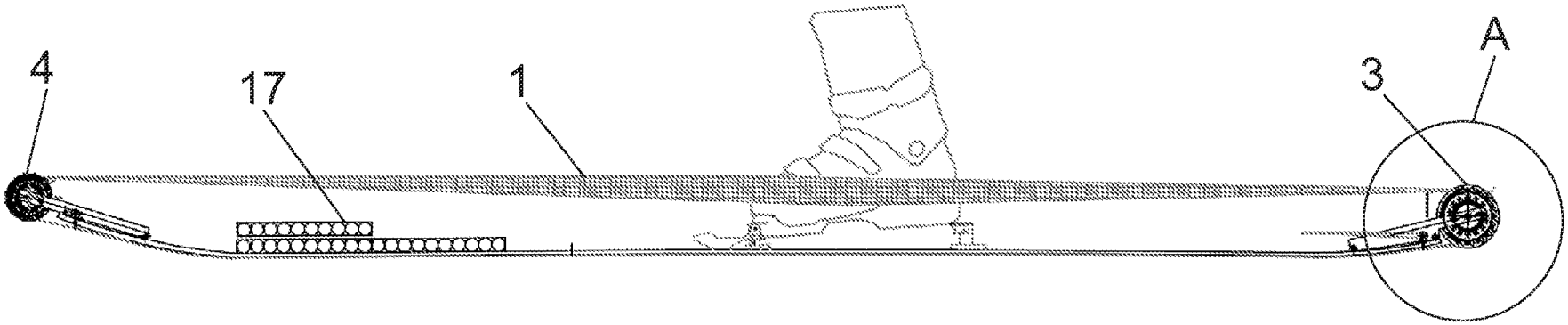
FIG. 1 shows a side view of a ski with a downhill ski binding and a personal self-propelled vehicle of the invention installed thereon.
Figure 2:
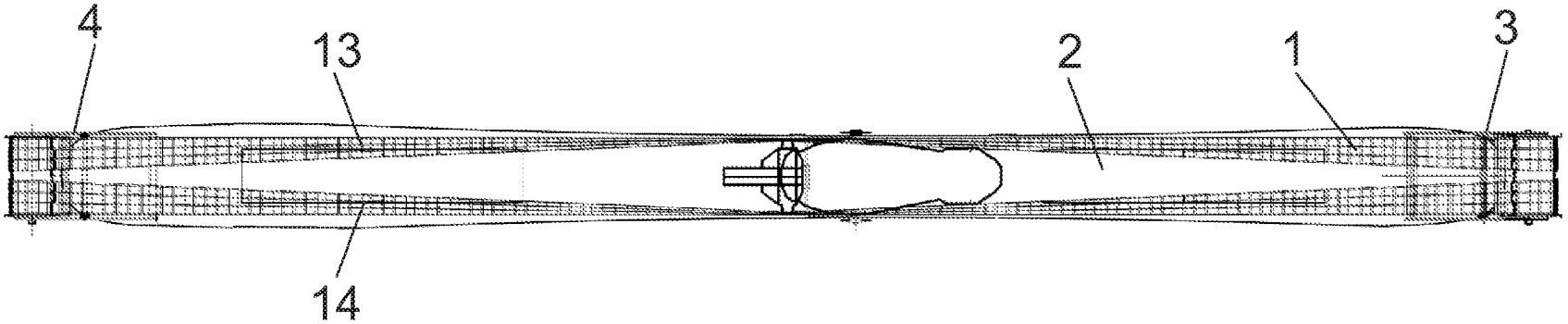
FIG. 2 shows a top view of FIG. 1.

The personal self-propelled vehicle generally depicted in FIGS. 1 and 2 includes a closed-loop flexible ribbon (1) that envelopes a ski 2 over its entire length and at least partially passes under a sliding surface of the ski 2, and two rollers 3 and 4 mounted on opposite ends of the ski 2 and engaged with the ribbon 1 to provide tension thereof. The roller 3 mounted on the rear end of the ski 2 is a driving roller. It is equipped with an embedded driving micromotor 5 located on the roller axis and having a control means, e.g., a controller (not shown in the drawings). The roller 4 mounted on the front end of the ski is a guiding roller that assures tension of the ribbon.

Figure 3:
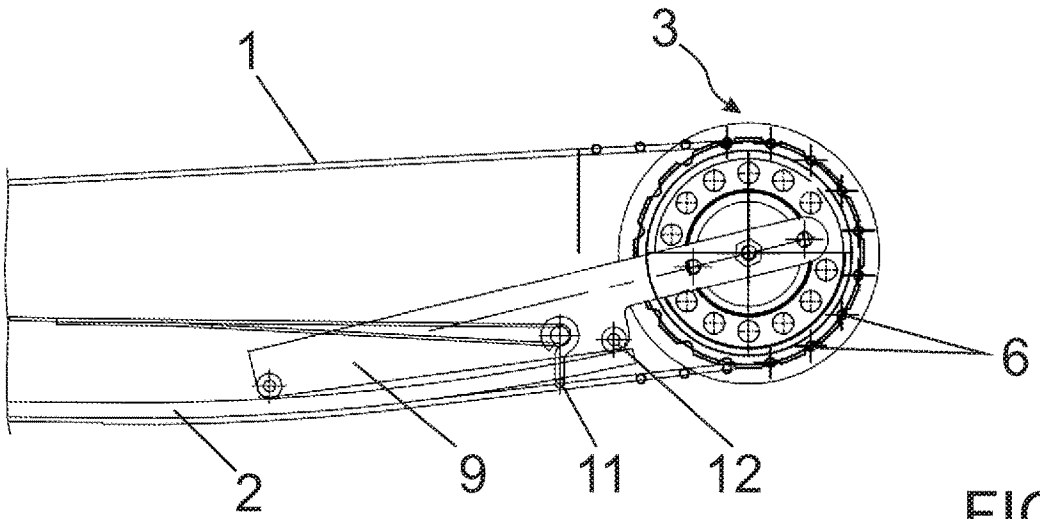
FIG. 3 shows an enlarged view of portion A of FIG. 1.
Figure 4:
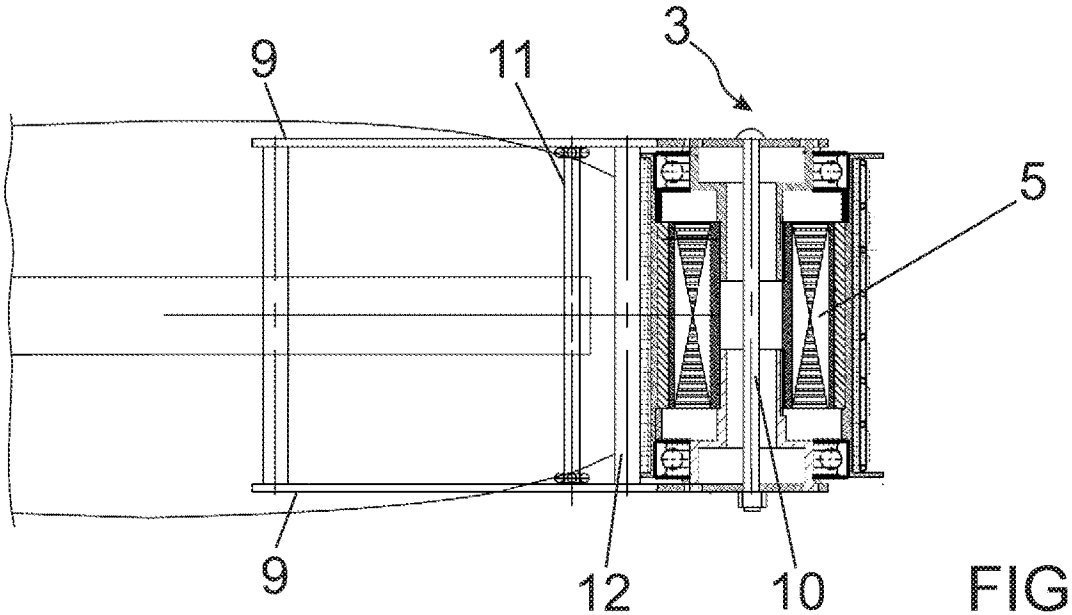
FIG. 4 shows a top sectional view of FIG. 3.

The closed-loop flexible ribbon 1 has a plurality of via openings and substantially constitutes a lattice (hereinafter referred to as the lattice 1). Cylinder surface of the driving roller 3, which enlarged view is shown in FIGS. 3 and 4, has projections or recesses (6) distributed over its circumference with intervals as shown in this example. The intervals correspond to pitch of openings 7 and webs 8 between the openings (the lattice cells) lengthwise the lattice 1, so the roller 3 is able to transfer force from the driving electric motor 5 to the lattice 1 while interacting with the cells thereof in order to provide translational movement.

Dimensions and positions of the cells 7 of the lattice 1 and parameters of the webs 8 between them are selected so as to provide support by snow for the slide surface of the ski during movement of the vehicle. The support is provided through the mentioned multiple openings taking into account sinking the webs 8 of the lattice 1 in upper snow layer that is packed by the ski under weight of the vehicle and the user. The webs 8 directed substantially transversally to the longitudinal axis of the ski assure repulsion from snow packed by the ski and sliding the ski in longitudinally forward direction. The webs 8 also facilitate avoiding ski slipping in backward direction.

Figure 5A:
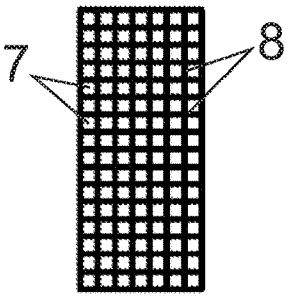
FIGS. 5A, 5B, 5C show implementation options of a lattice.
Figure 5B:
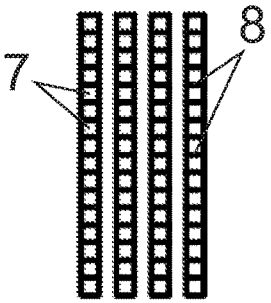
Figure 5C:
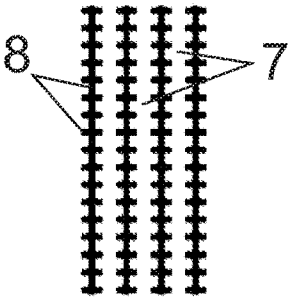

The lattice 1 may be implemented in form of a single canvas according to width of the ski, or in form of multiple (preferably two) parallel canvases of the lattice with cells (FIG. 1A), or in form of a single chain according to width of the ski, where the chain comprises pivotally connected links forming the mentioned openings, or in form of separate two or three parallel chains (FIG. 5B). The lattice (1) may also be formed of at least two flexible ties, depending on width of the ski, where the ties have rigid transversal projections extending in a horizontal plane, thus substantially defining the cells 7 (FIG. 5C). The lattice may be made of a rope, which may be a single fiber or a string, a cord, a wire or a braided line and may be produced by any suitable method selected from braiding, knitting, welding, molding, 3D-printing and growing. The lattice may also be made of a polymer material or may have polymer coating, e.g., it may be braided of polyamide (capron) strings and may have polyurethane coating. It may also be made of glass fiber and may have polytetrafluorethylene (teflon) coating. It is important that the lattice remains flexible and meets requirements related to its parameters selected so as to provide forward motion of the ski owing to counteraction of the lateral webs 8 of the lattice 1 to packed snow and owing to necessary strength of the lattice as a whole.

It shall be noted that in this case, the lattice 1 with the openings (the cells 7) simultaneously performs two functions, first, providing traction between the projections/recesses of the driving roller 3 for transferring translational motion, and second, assuring repulsion from snow packed by the ski to overcome friction force.

The lattice parameters are selected as follows.

Given that minimal shear resistance of snow described in literature is about 0.05 kgs/cm (at a load generated by a skier) and taking into account friction factor of 0.03 (for modern ski), a force required for horizontal travel of a skier having weight of 100 kg shall be equal to 100 kg (the skier weight)×0.03=3 kg. To provide moving uphill on a slope of, e.g., 20°, an additional force of 100 kg×sin 20°=34 kg is required. Therefore, total pulling force for moving uphill shall be equal to 34+3=37 kg. Taking into account the minimal snow shear resistance of 0.05 kgs/cm, minimal total area of the lateral webs in the portion of the lattice (1) adjacent to snow shall be 37/0.05=740 $cm^2$ or more. If, for example, vertical size of the lateral webs (8) of the lattice (1) is selected to be equal to 0.3 cm, their total length is equal to 10 cm, size of the cell (opening) is equal to 1.2 cm, and number of cells in the considered portion of the lattice is equal to 160 cm/1.2 cm=133, then total area of the lateral webs generating repulsive action is equal to 133×10×0.3=400 $cm^2$, which is more than calculated required value of 370 $cm^2$ for each ski.

Minimum possible diameter of longitudinal webs is prescribed by the lattice strength requirements.

Each of the driving roller 3 and the guiding roller 4 is equipped with a quick-detachable fastening means for attaching thereof to the rear end or to the front end of the ski 2, correspondingly, in order to make installation of the device onto the ski easier.

One of possible implementation options for such a fastening means applicable to the roller 3) is shown in FIGS. 3 and 4. The fastening means is provided in form of a removable add-on comprising a couple of arms 9. An axis 10 is mounted on first ends of them to provide rotation of the roller 3. The arms 9 are connected to each other by an eye bar 11, which opposite sides are attached to second ends of the arms 9. The eye bar 11 defines a slot corresponding to the ski rear end, so when installing the roller 3, the ski rear end enters the slot with a push-fit and become wedged. Reliability of the installation is assured by a rod 12 that prevents potential displacement of the eye bar 11 during motion of the skier.

Installation of the guiding roller 4 is similar to what was described in the above, except for that the slot of the eye bar 11 is formed corresponding to shape of the ski front end.

FIGS. 1 and 2 show an embodiment of the vehicle adapted to downhill ski, wherein the lattice 1 is divided into two parts over its entire length so as its upper portion splits into two sub-portions 13 and 14 near the ski binding, and each sub-portion passes along corresponding side of the user's boot. The sub-portions further come close and form a single canvas on the recesses 6 of the roller 3.

An embodiment of the personal vehicle to be used with downhill ski may also be implemented with the lattice in form of a single canvas, which width corresponds to width of the ski 2. In this case, the upper portion of the lattice canvas passes along outer side of the user's boot. This embodiment is most simple for production and installation on the ski, still providing good enough reliability of operation.

Figure 6:
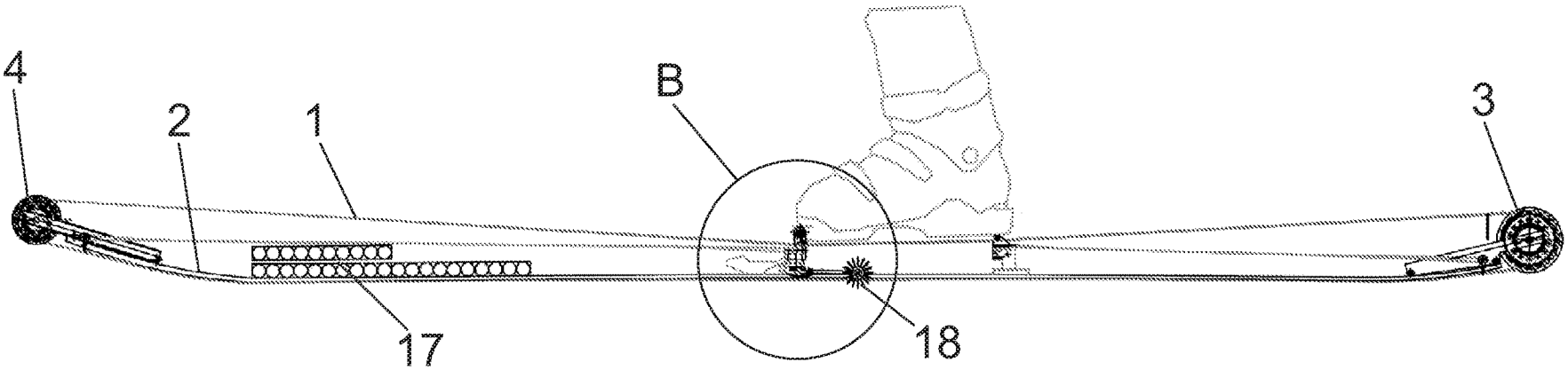
FIG. 6 shows a side view of a ski with a vehicle of the invention implemented with a passage for passing an upper portion of the flexible ribbon under the user's shoe sole.

FIG. 6 shows an embodiment of the personal vehicle according to the invention to be used with cross-country ski. The cross-country ski has a support for a user in form of a binding for moving on an even surface. This manner of moving with use of ski is less injury-causing, so requirements applicable to the ski binding related to fail-safe operation are less tough and such bindings may be equipped with removable overlays 15 with no compromising safety of the user, which may be installed when, e.g., a long and physically hard motion on an even surface is expected. The removable overlay 15 comprises a support surface similar to a support surface of a standard binding, but it has a through passage 16 for passing the upper portion of the lattice 1 through the overlay under the sole of the user's boot.

In addition, a battery 17 is provided as a part of the vehicle. The battery 17 is intended for powering the driving electric motor 5 that may be secured to a surface of the ski 2, e.g., using a magnet or a suction pad, or it may be held in a waist bag of the skier.

Figure 7:
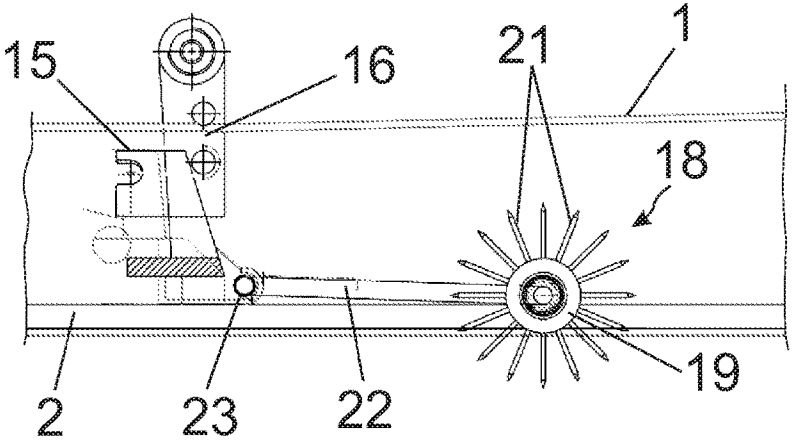
FIG. 7 shows an enlarged view of portion B of FIG. 6.
Figure 8:
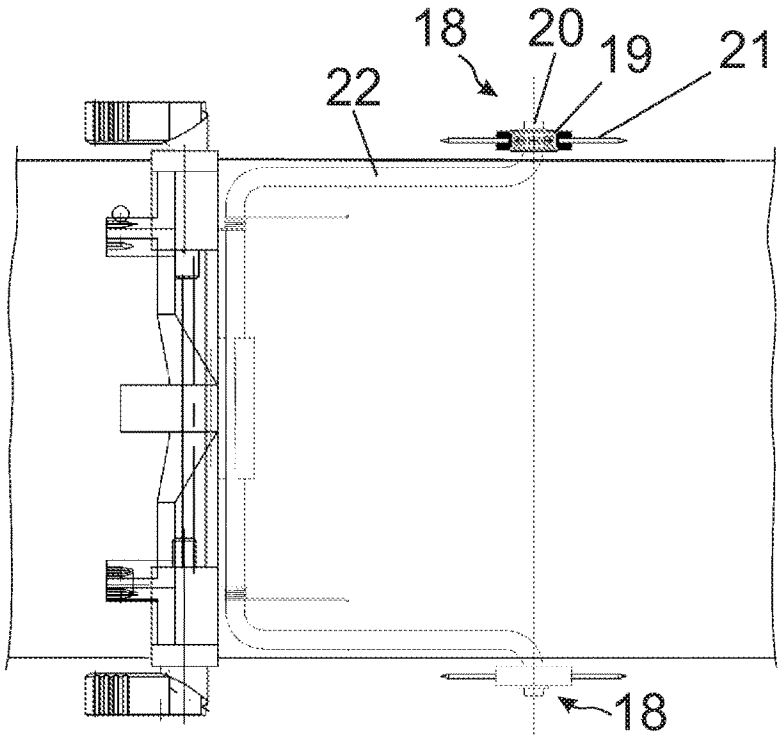
FIG. 8 shows a top view of FIG. 7.

Some embodiments of the vehicle may also be equipped with at least one couple of limiters 18 to limit displacement of the lattice 1 relative to the sliding surface of the ski (FIGS. 7 and 8), which is particularly important for a skewed downhill piste.

The limiter 18 is implemented in form of a sleeve 19 mounted on an axis 20 that is perpendicular to the longitudinal axis of the ski 2 in a horizontal plane (the ski plane) so as to provide free rotation of the sleeve. Side surface of the sleeve 19 has radially directed needle pins 21, and length of each of them is more than distance between the upper surface of the ski 2 and the lower surface of the lattice installed on the ski. The limiters 18 are mounted on ends of a U-shaped rod 22 configured to be inserted into a loop 23 of a standard downhill ski binding, that is intended for anti-slip claws.

The proposed personal vehicle for travelling on snow may successfully be used not only when the support for a net load is a binding for a shoe as in case of implementation of the personal vehicle for a ski or a snowboard, but also when the support is a platform for placing a human in sedentary or recumbent position as in case of implementation of the personal vehicle for a sleigh.

The personal self-propelled vehicle of the invention is used as follows.

The personal self-propelled vehicle of the invention intended for skiing includes a twin set of elements.

Prior to going up, the skier installs the driving roller 3 on the rear end of the ski, then secures it by the rod 12 and further fastens the battery 17 to the ski or leaves it in a bag. Next, the skier installs the guiding roller 4 on the front end of the ski in a first, intermediate position, then puts the lattice 1 over the ski so as to envelope the rollers 3 and 4 and pulls the lattice on by moving the roller 4 into its second, operational position by rotation over the axis of the eye bar 11. Further, the skier secures the operational position of the guiding roller 4 by the rod 12. Still further, the skier installs the rollers 3 and 4 and pulls the lattice onto the other ski. After that, the vehicle is ready for moving the user uphill.

Prior to going down, the skier uninstalls the equipment installed on the ski in the reverse order, then move it into a haversack and starts a run on a downhill piste as usual.

A test sample of the self-propelled vehicle of the invention was produced and tested.

The lattice 1 was made of caprone strings by braiding and covered with polypropylene by pouring over. The lattice was implemented as a closed-loop ribbon, which width corresponded to the ski width, with cells of 12×12 mm size and with webs, which diameter corresponded to the caprone strings with coating of about 0.3 mm depth. A skier of 85 kg weight was able to travel uphill on a slope of 20° with no any physical efforts.

Size of the test sample was 400×250×250 mm in folded position and its weight was about 10 kg.

The claimed personal self-propelled vehicle has simple, reliable, compact and light weight configuration. These advantages allow readily and easily mounting and dismounting the device elements on ski for moving up and down on a hill slope, as well as for moving over an even surface. After dismounting, elements of the proposed vehicle may be placed into a small haversack with no causing any discomfort to the user.

Owing to ski sliding over a packed snow surface during motion of the vehicle according the invention, friction loss is substantially decreased, which promotes increasing the device efficiency factor and decreasing energy consumption for its operation. This allows decreasing weight of the battery and, correspondingly, the whole device weight.

Thus, the claimed solution allows substantially facilitating uphill travel process and combining downhill skiing with even surface skiing with no excessive physical efforts, when using any commercially available ski.

What is claimed is:

1. A personal self-propelled vehicle for travelling on snow, comprising:

at least one ski having a first end, a second end that is opposed to the first end, a lower surface configured for sliding on snow, and an upper surface;

a support for a user installed on the upper surface;

a closed-loop flexible ribbon configured to envelope the ski over its length from the first end to the second end, so the ribbon passes under at least a portion of the lower sliding surface;

a first roller that is a driving roller configured to be installed on the first end of the ski and to interact with the ribbon for transferring force to the ribbon so as to provide translational movement thereof;

a motor of the driving roller;

a control means of the motor;

a second roller that is a guiding roller configured to be installed on the second end opposed to the first end of the ski, wherein a canvas of the ribbon comprises a plurality of via openings separated from each other by webs to substantially form a lattice, while sizes and positions of the openings and parameters of the webs are selected so the sliding surface of the ski abuts on snow through the openings during motion of the vehicle, while the webs sink in snow under load of the vehicle and the user and provide repulsion from snow packed by the ski to assure sliding the ski on snow surface in longitudinal direction.

2. The vehicle of claim 1, wherein projections/recesses are provided on a cylinder surface of the driving roller along circumference thereof, the projections/recesses configured to interact with at least some of the openings.

3. The vehicle of claim 2, wherein the canvas of the ribbon is a lattice made of a rope, and cross-section size of the rope in a vertical plane is selected to be enough for providing repulsion of the lattice from snow packed by the ski bearing the user.

4. The vehicle of claim 3, wherein the rope is selected from a fiber, a string, a cord, a wire and a braided line.

5. The vehicle of claim 3, wherein the lattice is made using a method selected from braiding, welding, molding, knitting, 3D-printing and growing.

6. The vehicle of claim 3, wherein the lattice is made of a polymer material or has a polymer coating.

7. The vehicle of claim 2, wherein the canvas of the ribbon is provided in a form of at least one chain with links pivotally connected to each other so as to form the openings.

8. The vehicle of claim 2, wherein the canvas of the ribbon comprises at least two flexible ties, the ties having rigid transversal projections, which substantially define the openings.

9. The vehicle of claim 1, wherein each of the driving roller and the guiding roller is equipped with a means for detachable fastening to the corresponding end of the ski.

10. The vehicle of claim 9, wherein the detachable fastening means comprises a removable add-on provided in form of an eye bar comprising a through slot for push-fit engaging with the corresponding end of the ski, and a couple of arms, where first ends of the arms are attached to opposite sides of the eye bar and a rotational axis of the corresponding roller is attached to second ends of the arms.

11. The vehicle of claim 1, further comprising limiters to limit displacement of the ribbon relative to the sliding surface of the ski, each limiter provided in form of a sleeve rotatably mounted on an axis comprising a means for fastening to the ski substantially perpendicular to the longitudinal axis of the ski, wherein side surface of the sleeve has radially directed needle pins, and length of each of the pins is more than a distance between the upper surface of the ski and the lower surface of the ribbon installed on the ski.

12. The vehicle of claim 1, wherein the support for the user is a downhill ski binding and the lattice is configured so its upper portion is able to move along at least one of sides of a user's boot during motion of the vehicle.

13. The vehicle of claim 12, wherein the lattice is divided into two parts over its whole length so the upper portion is configured to split into two sub-portions near the downhill ski binding, and each sub-portion passes along the corresponding side of the user's boot and further the sub-portions are combined to form a single canvas on the projections/recesses of the driving roller or the guiding roller.

14. The vehicle of claim 1, wherein the support for the user is a cross-country ski binding equipped with a removable overlay comprising a support surface similar to a support surface of the binding and a passage for free passing the upper portion of the ribbon between the overlay and the upper surface of the ski.

* * * * *